US007682466B2

(12) United States Patent
Kahrig

(10) Patent No.: US 7,682,466 B2
(45) **Date of Patent: *Mar. 23, 2010**

(54) NOZZLE APPARATUS

(75) Inventor: Randy Kahrig, 800 Scott St., Worthington, KY (US) 41183

(73) Assignee: Randy Kahrig, Worthington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/371,003

(22) Filed: Feb. 13, 2009

(65) Prior Publication Data

US 2009/0145467 A1 Jun. 11, 2009

Related U.S. Application Data

(63) Continuation of application No. 11/625,582, filed on Jan. 22, 2007, now Pat. No. 7,497,224.

(60) Provisional application No. 60/794,866, filed on Apr. 25, 2006.

(51) Int. Cl.
*F28G 15/02* (2006.01)

(52) U.S. Cl. ..... 134/166 R; 122/379

(58) Field of Classification Search ..... 134/166 R
See application file for complete search history.

(56) References Cited

U.S. PATENT DOCUMENTS 4,218,016 A 8/1980 Freund ..... 239/186
4,503,811 A 3/1985 Hammond ..... 122/392
5,230,306 A 7/1993 Barringer et al. ..... 122/383
5,271,356 A 12/1993 Kling et al. ..... 122/392
5,348,234 A * 9/1994 v.d. Woude ..... 239/753
5,379,727 A 1/1995 Kling et al. ..... 122/392
5,509,607 A 4/1996 Booher et al. ..... 239/289
5,579,726 A 12/1996 Finucane ..... 122/379
6,050,227 A * 4/2000 LaMotte ..... 122/379
6,283,069 B1 9/2001 Bude et al. ..... 122/379

FOREIGN PATENT DOCUMENTS

JP 56082548 A 6/1981
JP 410030898 2/1998

* cited by examiner

*Primary Examiner*—Michael Barr
*Assistant Examiner*—Jason P Riggleman
(74) *Attorney, Agent, or Firm*—Harness, Dickey & Pierce, P.L.C.

(57) ABSTRACT

An apparatus is provided that includes a length of pipe having a passageway for communicating a liquid under pressure therethrough, and at least one nozzle in communication with the passageway. The at least one nozzle is configured to discharge a liquid, a portion of which is discharged in a stream, and a portion of which is discharged in a volume of aspirated spray. The aspirated spray effectively shields the pipe and the at least one nozzle from heat radiating within the enclosure. The apparatus further includes a displacement device for controllably displacing the length of pipe. The length of pipe and at least one nozzle are configured to be extended through an opening in the enclosure for discharging a stream of liquid for cleaning a surface within the enclosure.

20 Claims, 3 Drawing Sheets

NOZZLE APPARATUS

CROSS-REFERENCE TO RELATED APPLICATIONS

This application is a continuation of U.S. patent application Ser. No. 11/625,582, filed Jan. 22, 2007, now U.S. Pat. No. 7,497,224, which claims the benefit of U.S. Provisional Patent Application Ser. No. 60/794,866, filed Apr. 25, 2006, the entire disclosure of which is incorporated herein by reference.

FIELD

The present disclosure relates to apparatus for discharging a stream of liquid under pressure, and more specifically to cleaning apparatus that discharge liquid under pressure in high heat environments.

BACKGROUND

The statements in this section merely provide background information related to the present disclosure and may not constitute prior art.

Combustion chambers and heat exchangers of boilers and the like can accumulate soot, slag and ash on surfaces along the chamber or heat exchanger. Thorough cleaning of such surfaces may require opening up the chamber, which would essentially put the boiler or heat exchanger out of operation or service. Cleaning such surfaces without shutting down operation presents other challenges that have yet to be overcome.

SUMMARY

The present disclosure relates to a liquid sprayer or lance for cleaning a combustion chamber or heat transfer surface in a boiler, combustion chamber, or other high heat enclosure. Various embodiments of a cleaning apparatus are provided that are configured to extend through an opening in the chamber or enclosure to permit discharge of a liquid under pressure for cleaning surfaces within the chamber or enclosure. In one embodiment, an apparatus is provided that includes at least one nozzle for dispensing a liquid under pressure. The apparatus further includes a conduit for communicating a liquid under pressure to the at least one nozzle. The conduit is movable for extending the at least one nozzle through an opening in an enclosure to permit dispensing of liquid within the enclosure. The apparatus further includes a linear displacement device configured to controllably move the conduit, wherein the conduit and at least one nozzle are adapted to be extended through an opening in an enclosure in which the liquid is dispensed to clean a surface in the enclosure. The apparatus may further include an adjustable support for the conduit, for changing the angle of the conduit to align the nozzle for controlling the direction of discharging liquid under pressure.

In another embodiment, an apparatus is provided that includes a nozzle for dispensing a liquid under pressure and a conduit having a passageway for communicating a liquid under pressure therethrough to the at least one nozzle. The conduit extends in a cantilevered manner for enabling the at least one nozzle disposed at an end of the conduit to be extended though an opening in an enclosure. The apparatus further includes a linear displacement device for controllably moving the cantilevered portion of conduit, for extending the conduit and at least one nozzle through an opening in an enclosure for discharging a liquid under pressure for cleaning a surface within the enclosure. An adjustable support member may be included that supports at least a portion of the conduit opposite the cantilevered end having the at least one nozzle. The support member is configured to adjustably raise or lower a portion of the conduit for leveling the cantilevered end portion of the conduit so as to substantially align the at least one nozzle to discharge a liquid under pressure within a generally vertical plane.

In another aspect of the present invention, various embodiments of a method is provided for cleaning an enclosure using a liquid discharging apparatus. One embodiment of a cleaning method includes activating a pump for providing a liquid under pressure, and controlling a drive mechanism for controllably moving a length of conduit having at least one nozzle thereon through an opening within the enclosure. The method further includes selectively activating the discharge of liquid through the at least one nozzle to discharge a liquid towards at least one surface within the enclosure, and to rotate the conduit having the at least one nozzle thereon to discharge a portion of liquid under pressure 360 degrees about the axis of the conduit. The linear displacement device is operable to controllably advance or extend the conduit and nozzle into the enclosure for cleaning at least one surface within the enclosure.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
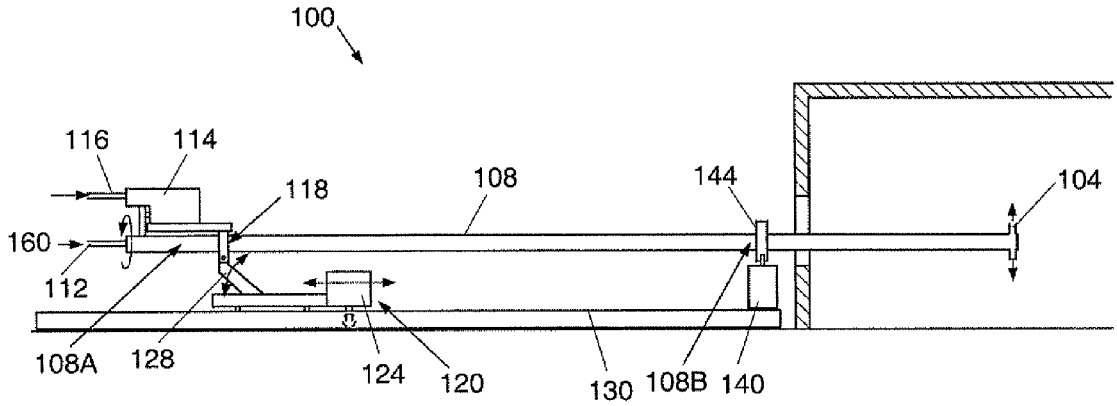
FIG. 1 shows an illustration of one embodiment of an apparatus for extending a discharge nozzle in an enclosure in accordance with the principles of the present application.

The following description is merely exemplary in nature and is not intended to limit the present disclosure, application, or uses. It should be understood that throughout the drawings, corresponding reference numerals indicate like or corresponding parts and features.

In various embodiments of a cleaning apparatus, the liquid sprayer is separate from the boiler or apparatus, and is configured to extend through an opening in the chamber or enclosure to permit discharge of a liquid under pressure for cleaning surfaces within the chamber or enclosure.

One embodiment of a liquid sprayer apparatus is shown generally at 100 in FIG. 1. The apparatus 100 provides for dispensing a liquid under pressure for cleaning a surface within an enclosure, and comprises at least one nozzle 104 for dispensing a liquid under pressure. The apparatus 100 further comprises a conduit 108 for communicating a liquid under pressure to the at least one nozzle 104. A pump or a number of pumps arranged in series (not shown) provide for the supply of liquid under pressure to the conduit 108 at an inlet 112. The conduit 108 is movable for moving a portion of the conduit extending in a cantilevered manner and the at least one nozzle 104 through an opening in an enclosure of a steam boiler, combustion chamber, or the like, to permit dispensing of liquid within the enclosure.

The apparatus further includes a linear displacement device 120 that is configured to controllably move the conduit 108 in and out of an enclosure. As the conduit 108 and nozzle 104 are extended into an enclosure, the portion of conduit 108 extending in a cantilevered manner into the enclosure will deflect relative to its cross-sectional stiffness. It may be desirable to maintain discharge of liquid under pressure from the nozzle 104 in a vertical direction, or in a vertical plane, for spraying liquid between vertically stacked tubing arranged in a spaced apart manner within a boiler, for example. In some boilers, the spacing between such vertically stacked tubing may be less than 2 inches. To maintain the alignment of the nozzle 104 in a generally vertical plane for spraying liquid within such a narrow spacing, an adjustable support member 128 is provided for raising and lowering at least a portion of one end of the conduit 108. The adjustable support member 128 supports at least a portion of the conduit 108, and is configured to adjustably raise or lower the conduit to change the angle of the cantilevered end portion of the conduit 108 to offset any deflection in the conduit as it is extended. Accordingly, the adjustable support member 128 raises or lowers an end portion of the conduit 108 to level the cantilevered end portion of the conduit 108 being extended within an enclosure, such that the nozzle 104 is substantially aligned for discharging a stream of liquid under pressure in a generally vertical plane. It should be noted that the at least one nozzle may be configured to discharge liquid in a circumferential pattern 360 degrees around the axis of the conduit 104. Such an arrangement would allow the nozzle 104 to discharge liquid within a generally vertical plane for cleaning surfaces, such as between closely spaced vertically stacked tubing within a boiler enclosure.

In the first embodiment of an apparatus 100, the conduit 108 and at least one nozzle 104 are adapted to be extended through an opening into a combustion chamber or enclosure in which a high heat environment exists. Such an enclosure may be an active combustion environment, or a high temperature environment absent combustion that is radiating latent heat. The at least one nozzle 104 discharges a liquid under pressure to establish a stream or flow of liquid in a given direction. The liquid is discharged at an effective velocity for causing the flow to project towards a surface within the enclosure to remove contaminants, slag, and/or ash along various surfaces due to the energy of the liquid. By discharging the liquid within the enclosure while the enclosure is at a high temperature, the cooler liquid contacting the contaminants also causes the contaminants to peal away due to thermal shock.

In the first embodiment, the conduit 108 may be rotated 360 degrees about is axis to rotate the nozzle 104 disposed at the end of the conduit for discharging liquid under pressure in a 360 range of spray. The conduit may be received within a roller bearing 118 for supporting the conduit 108 in a rotating manner. The apparatus may also comprise an actuator 114 for selectively rotating the conduit 108 about its longitudinal axis at a desired rate, such that the at least one nozzle 104 on the cantilevered end of the conduit 108 may discharge a liquid under pressure 360 degrees about the axis of the conduit 108, for cleaning interior surfaces within an enclosure. The actuator 114 preferably includes a pneumatically operated drive that is connected to a compressed air source at 116, and is operatively connected to the conduit 108 for controllably rotating the conduit 108.

In an alternate construction of the first embodiment, the apparatus may further comprise a barrel (not shown in FIG. 1) surrounding at least part of the length of conduit 108 rather than a roller bearing support, where the conduit 108 rotates within the barrel. The inner diameter of the barrel surrounding at least a portion of the conduit 108 also defines a space between the conduit 108 and barrel in which a coolant is received for conducting heat away from the barrel and conduit 108. When a cantilevered portion of the barrel and conduit 108 are extended within an enclosure of a boiler, the barrel and conduit 108 may absorb heat being radiated within the boiler enclosure. The nozzle may also be configured to discharge at least a portion of liquid in a volume of aspirated spray that intervenes between the at least one nozzle and the heat being radiated within the enclosure. The coolant between the barrel and conduit 108 and the portion of the liquid discharged in the form of a volume of aspirated spray effectively cool the at least one nozzle 104, barrel and conduit 108 extending within the boiler, to hinder droop of the cantilevered end of the barrel 158 and conduit 108 for permitting the discharge of a stream of liquid under pressure within a generally vertical plane in a high heat environment for up to four hours. For example, one embodiment of an apparatus having such cooling systems may be used within a boiler which is operating at a very high temperature for a predetermined minimum time period.

In the first embodiment, the linear displacement device 120 may comprise a trolley 124 that is movable along a length of track 130, which trolley 124 supports at least a portion of the conduit 108 near its proximal end 108A. The length of track 130 comprises a pair of spaced apart, generally parallel track members, but may alternatively comprise comparable track means suitable for guiding a trolley support in a linear manner. The trolley 124 supporting the portion of the conduit 108 is configured to adjustably raise and lower the conduit end 108A to a desired position. The trolley 124 preferably is secured to the conduit or pipe 108, using a clamping device. Thus, movement of the trolley 124 effectively causes the conduit 108 to move. The apparatus 100 further comprises a stationary trolley 140 that is configured to adjustably raise or lower a roller member 144 to a desired position or height, which roller member 144 supports at least one other conduit portion 108B while permitting movement of the conduit 108 relative to the stationary trolley 140. The moveable trolley 124 and the roller 144 on the stationary trolley 140 permit the conduit 108 to be moved or displaced in a linear manner, for enabling the conduit 108 to be extended through an opening in a combustion chamber or enclosure. Accordingly, the linear displacement device 120 may be operated to controllably displace the length of conduit 108, wherein the conduit 108 and at least one nozzle 104 may be extended through an opening in an enclosure for discharging a stream of liquid to clean a surface within the enclosure.

The trolley 124 supporting the conduit 108 is movable by a motorized drive mechanism (not shown), which is operable to move the trolley 124 along the length of track 130, and thereby the conduit 108. The trolley 124 supporting the conduit 108 may be movable by a hydraulic drive mechanism or a motorized drive mechanism. The drive mechanism may be controlled to selectively advance the conduit 108 and the at least one nozzle 104 to a point at or just within the opening in the enclosure, before establishing the flow or discharge of liquid from the at least one nozzle 104.

The conduit 108 has a passageway therein for communicating a liquid under pressure to the nozzle 104. The apparatus further includes a pump 160 that controllable to selectively supply a liquid under pressure to the passageway in the conduit or pipe 108, for establishing discharge of liquid from the at least one nozzle 104. A flow control valve for controlling the supply of liquid under pressure from the pump to the passageway may also be included. The valve may further include a bypass valve position to maintain flow of liquid through the pump when pressurized liquid is not being supplied to the passageway. The pump may be activated to provide a liquid under pressure, and the valve may be operated to selectively activate supply of liquid under pressure to the conduit 108 for discharge through the at least one nozzle 104 an effective distance for cleaning surfaces within an enclosure.

Figure 2:
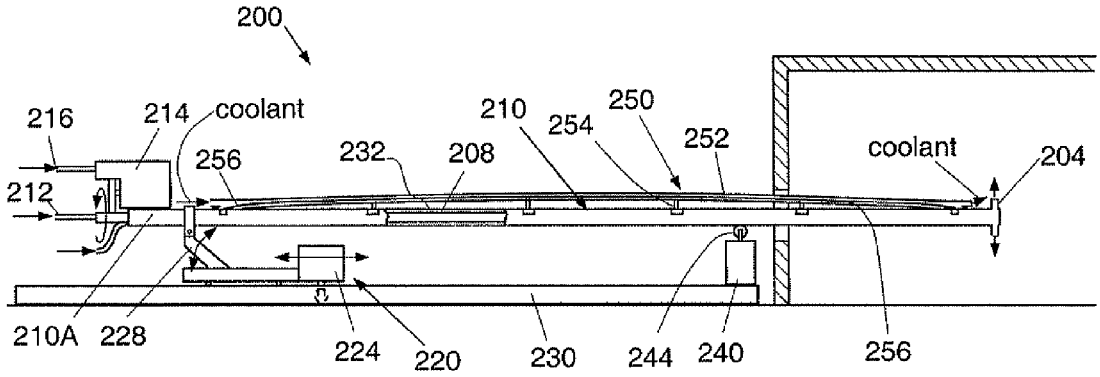
FIG. 2 shows an illustration of a second embodiment of an apparatus for extending a discharge nozzle in a boiler enclosure in accordance with the principles of the present application.
Figure 3:
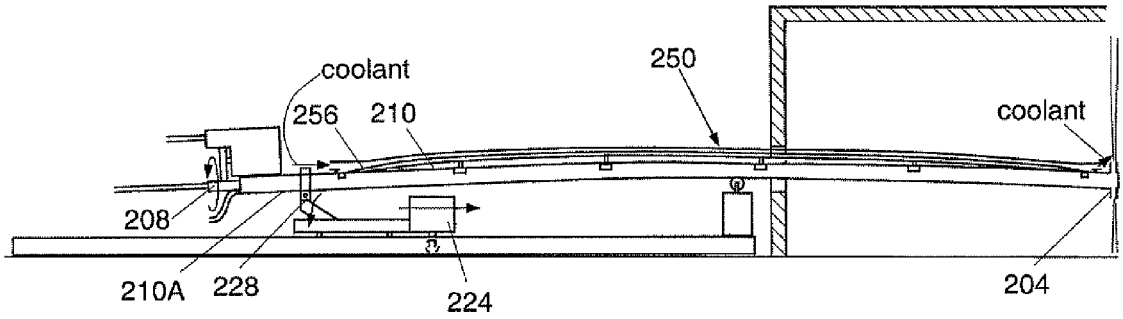
FIG. 3 shows the apparatus in FIG. 2 extending into a boiler enclosure for cleaning surfaces within the boiler.
Figure 4:
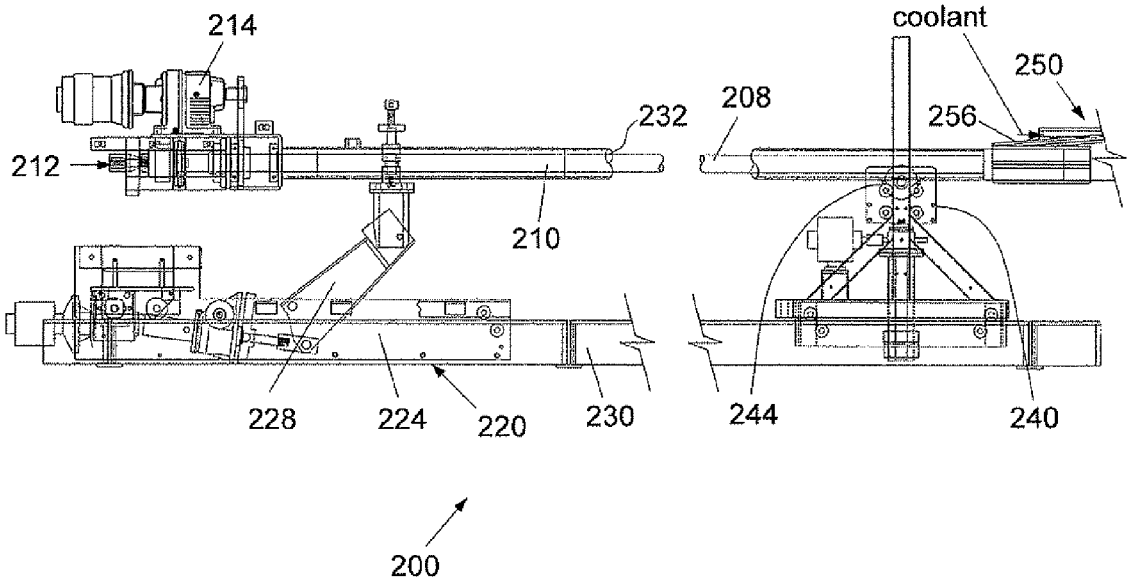
FIG. 4 is an enlarged cut-away side elevation view of the apparatus in FIG. 2, shown in more detail.

In a second embodiment, an apparatus 200 is provided for discharging a liquid under pressure within a boiler enclosure as shown in FIG. 2. The second embodiment of an apparatus 200 provides for extending a lance or conduit 208 for communicating a liquid under pressure to at least one nozzle 204 on the end of the conduit 208. The apparatus 200 is capable of traveling at least 55 feet within an enclosure for extending at least one nozzle 204 capable of projecting a liquid under pressure at least 30 feet, whereby the apparatus is capable aligning the extended nozzle 204 for discharging a liquid under pressure in a controlled direction for cleaning surfaces within an enclosure at a temperature of at least 1000 degrees Fahrenheit for a period of at least 1½ hours up to 6 hours.

The apparatus 200 comprises a length of conduit pipe 208 having a passageway for communicating a liquid under pressure therethrough. The apparatus 200 includes a barrel 210 surrounding at least part of the length of conduit 208, where the barrel 210 and part of the length of conduit 208 disposed within the barrel extend in a cantilevered manner. The apparatus 200 further comprises at least one nozzle 204 disposed on the cantilevered end of the conduit 208, which is in communication with the passageway in the conduit pipe 208. The at least one nozzle 204 is configured to discharge a liquid under pressure for cleaning an interior surface within an enclosure.

In the second embodiment, the barrel 210 preferably has an outside diameter of about 3 inches, and a passageway therein of sufficient size for receiving the conduit 208, which preferably has an outside diameter of about 2 inches and an inside diameter of about 1.5 inches. The apparatus 200 may further include one or more bushings (not shown) within the barrel 210 for providing support to the conduit 208 received within the barrel 210. It should be noted that the barrel 210 and conduit 208 may comprise different sizes depending on the application in which the apparatus 200 is to be used for, such that the present disclosure should not be limited to the particular disclosed embodiments and such modifications may be made without departing from the scope of the claims.

The at least one nozzle may comprise two or more nozzles 204 disposed and arranged on the distal end of the conduit 208 for discharging liquid in opposing directions as shown in FIG. 2. The nozzles 204 are configured to discharge a liquid under pressure there through, and preferably discharge the liquid at an effective velocity for projecting up to a distance of at least 25 feet for cleaning an interior surface within an enclosure. The at least one nozzle 204 is preferably carbon covered insert disposed within a stainless steel housing that establishes a constriction through which the liquid under pressure is discharged or projected. The liquid being discharged may be comprised of water or other cleaning solution that is supplied at a cool temperature relative to the temperature of the enclosure being cleaned. Where the enclosure is a boiler, for example, cooled liquid projected by the nozzle 204 towards boiler surfaces covered with an accumulation of high temperature soot, slag and ash will cause the accumulation to explode and separate from the boiler enclosure surfaces. At least a portion of the liquid dispensed by the nozzle is discharged in a volume of aspirated spray that intervenes between the at least one nozzle and any heat that is being radiated within an enclosure. The aspirated spray helps shield the at least one nozzle 204 that is being extended within a boiler enclosure from heat being radiated within the boiler.

The apparatus also includes an adjustable support 228 for supporting at least a portion of the barrel 210 and conduit 208, which is configured to adjustably raise or lower one end portion of the barrel 210 and conduit 208. As the conduit 208 and nozzle 204 are extended into a boiler, for example, a portion of the barrel 210 and conduit 208 within the barrel 210 that extend in a cantilevered manner into the boiler enclosure will deflect relative to the load on the extending portions. It may be desirable to align the direction of nozzle discharge in a generally vertical plane, for spraying liquid between vertically stacked tubing arranged in a spaced apart manner within a boiler enclosure, for example. In some boilers, the spacing between such vertically stacked tubing may be less than 2 inches, which would require alignment of the nozzles 204 to effectively clean between such boiler structure. To maintain the alignment of the nozzle 204 in a generally vertical plane for spraying within such a narrow spacing, an adjustable support 228 is provided for raising and lowering an end portion of the barrel 210 and conduit 208 received therein, to adjust the angle of the cantilevered end portion of the conduit 208. The adjustable support 228 comprises a pivotal support mounted to the trolley that pivotally raises the conduit though application of pressure to a cylinder. Adjusting the angle of the barrel 210 and conduit 208 allows for offsetting any deflection in the extended cantilevered portions to maintain the end of the conduit 208 in a horizontal position (with the nozzles 204 discharging in a generally vertical plane). Accordingly, the adjustable support 228 raises or lowers an end portion of the barrel 210 and conduit 208 to level the cantilevered end portion of the conduit 208, such that the nozzles 204 are substantially aligned for discharging a liquid under pressure in a generally vertical plane.

The apparatus further includes an actuator 214 for selectively rotating the conduit 208 about its longitudinal axis, relative to the barrel 210. The actuator 214 is disposed at one end of the barrel 210, and includes a pneumatically operated drive supplied by a compressed air source at 216. The pneumatically operated drive is operatively connected to the conduit 208 for controllably rotating the conduit 208 within the barrel 210. The conduit 208 may be rotated such that the nozzles 204 on the cantilevered end of the conduit 208 may discharge a liquid under pressure 360 degrees about the axis of the conduit 208. The actuator may be pneumatically operated, and may be controllable to rotate the conduit 208 at a desired rate up to 20 revolutions per minute. It should be noted, however, that the rate of rotation may be varied to accommodate the particular enclosure being cleaned (eg. slower for larger boilers or faster for smaller boilers).

The apparatus preferably includes a pump or a number of pumps arranged in series (not shown) that provide for the supply of liquid under pressure to the conduit 208 at an inlet 212. The one or more pumps are controllable to selectively supply a liquid under pressure to the passageway in the conduit or pipe 208, for establishing discharge of liquid from the at least one nozzle 204. In the second embodiment, the one or more pumps may comprise three pumps that are plumbed with the discharge line connected serially to the suction line of a subsequent pump in a serial arrangement. The one or more pumps are preferably diesel powered and are capable of supplying a liquid under pressure of up to 10,000 pounds per square inch at 300 gallons per minute to the inlet 212 of the conduit 208. The liquid under pressure is supplied to the conduit 208 via a flexible hose that is connected to the end of the conduit 208 using a hammer lock threaded fitting, or the like. A flow control valve (not shown) for controlling the supply of liquid under pressure from the pump to the passageway of the conduit 208 may also be included for selectively establishing flow of liquid under pressure through the conduit 208. The flow control valve may further include a bypass valve position to maintain flow of liquid through the pump when pressurized liquid is not being supplied to the passageway. The pump may be activated to provide a liquid under pressure, and the valve may be operated to selectively activate supply of liquid under pressure to the conduit 208 for discharge through the at least one nozzle 204, which discharges at least a portion of the liquid towards at least one surface within the enclosure.

The inner diameter of the barrel 210 surrounding at least a portion of the conduit length also defines a space 232 between the outside of the conduit 208 and barrel. A coolant is received in the space between the barrel 210 and the conduit 208, for conducting heat away from the barrel 210 and conduit 208. When a cantilevered portion of the barrel 210 and conduit 108 are extended within an enclosure of a boiler operating at 1000 degrees Fahrenheit or more, the barrel 210 and conduit 208 will absorb heat being radiated within the boiler enclosure. The at least one nozzle 204 is also be configured to discharge at least a portion of liquid in a volume of aspirated spray that intervenes between the at least one nozzle to absorb heat being radiated within the boiler enclosure. The coolant in the space 232 between the barrel 210 and conduit 208 and the volume of aspirated spray both provide for effectively cooling the at least one nozzle 204, the barrel 210 and the conduit 208 to hinder droop of the cantilevered end of the barrel and conduit, for enabling the apparatus to discharge of liquid under pressure within a generally vertical plane within an enclosure having a temperature of at least 1000 degrees Fahrenheit enclosure for at least an hour.

The second embodiment may further include a suspension support 250 for providing support to the cantilevered portion of the barrel 210 and conduit 208. The suspension support 250 is disposed on the cantilevered end of the barrel 210, for reducing the amount of deflection in the cantilevered barrel surrounding the conduit. By reducing the amount of deflection in the cantilevered barrel 210, the cantilevered end of conduit 208 may be more easily leveled for aligning the at least one nozzle 204 to enable discharge of a stream of liquid under pressure within a generally vertical plane. The suspension support generally comprises a length of tubing 252 suspended above the barrel 210 by one or more supports 254 connected to landings on the barrel 210, where the ends of a cable 256 extending through the tubing 252 are connected to the barrel 210 to place the upper portion of the barrel 210 under compression. The cable 256 is preferably a stainless steel braided cable which may be replaced connected to the barrel 210, and may be cooled by a coolant that is received within the tubing 252 between the tubing 252 and the cable 256. The combination of the coolant between the barrel 210 and the conduit 208, and the cooled suspension support 250 allow the apparatus to be extended within a high temperature enclosure to discharge a liquid under pressure in a controlled direction for a period of up to 6 hours. For example, in the second embodiment of an apparatus 200 employing the above cooling, the apparatus 200 may be extended within a boiler operating in the range of 2200 to 3000 degrees Fahrenheit, and the cooling hinders droop of the cantilevered end of the barrel 210 and conduit 208 to permit discharge of liquid under pressure within a generally vertical plane for spraying between spaces less than 2 inches in width for up to four hours.

The second embodiment further comprises a linear displacement device 220 that is configured to controllably move the barrel 210 and the conduit 208 disposed within the barrel 210. The linear displacement device 220 comprises a trolley 224 that is movable along a length of track 230, which trolley 224 supports at least a portion of the barrel 210 near its proximal end 210A. The trolley 224 is preferably connected or secured to the barrel 210 using a clamping device or the like. The length of track 230 comprises a pair of spaced apart, generally parallel track members, but may alternatively comprise comparable track means suitable for guiding a trolley support in a linear manner. The trolley 224 is movable by a motor driven actuator, and may further include an air bag that is inflated by a pneumatic pressure for pushing wheels or rollers (not shown) associated with the trolley against the parallel track members.

The apparatus 200 may further comprise a stationary trolley 240 that is configured to adjustably raise or lower a roller member 244 to a desired position or height, which roller member 244 supports a portion of the barrel 210. The roller member 244 supports the barrel 210 while permitting movement of the barrel 210 relative to the stationary trolley 240, such that the barrel 210 is extendable beyond the roller member 244 in a cantilevered manner. The moveable trolley 224 and the roller 244 on the stationary trolley 240 permit the barrel 210 to be moved or displaced in a linear manner, for enabling the barrel 210 and conduit 208 to be extended through an opening in a combustion chamber or enclosure. Accordingly, the linear displacement device 220 may be operated to controllably move the barrel 210 and a length of conduit 208, wherein the barrel 210, conduit 208 and the nozzles 204 may be extended beyond the stationary trolley 240 through an opening in an enclosure for discharging a liquid to clean a surface within the enclosure.

The trolley 224 supporting the barrel 210 and the conduit 208 may be movable by a hydraulic drive mechanism or a motorized drive mechanism. The drive mechanism may be controlled to selectively advance the barrel 210, the conduit 208 and the at least one nozzle 204 to a point at or just within the opening in the enclosure, at which point the flow or discharge of liquid from the at least one nozzle 204 may be established. The drive mechanism may be controlled to move the trolley 224 and thereby the conduit 208 at a select rate for controllably extending the nozzles 204 within a boiler enclosure at any desired rate for cleaning the boiler enclosure. The trolley 224 is configured to travel along a length of track 230 that enables the at least one nozzle 204 on the cantilevered end of the conduit 208 to be extended at least 12 feet within an enclosure. More preferably, the cantilevered end of the barrel 210 and conduit 208 extend up to 55 feet, and the trolley 224 and track 230 are configured to enable the nozzles 204 on the end of the conduit 208 to extend at least 50 feet within a boiler enclosure. Thus, the second embodiment of an apparatus provides for movably extending a conduit 208 through an opening within a boiler enclosure up to a length of 55 feet, where the apparatus may be extended through openings on opposite ends of a boiler to permit discharge of liquid in a controlled direction for cleaning boiler sizes up to 110 feet in length, and the nozzle projects liquid under pressure up to 25 feet to permit cleaning of boiler sizes up to 50 feet in width, while the boiler enclosure is at a temperature of up to 3000 degrees Fahrenheit.

In another aspect, various embodiments of a cleaning method are provided for discharging a stream of liquid within an enclosure having a high heat environment. The method comprises activating a pump for providing a liquid under pressure, and controlling a drive mechanism for controllably moving a conduit having at least one nozzle thereon through an opening within the enclosure. The method further includes selectively activating the discharge of liquid through the at least one nozzle to discharge a portion of liquid in a stream for impinging against at least one surface within the enclosure, and to discharge a portion of liquid in a volume of aspirated spray that effectively shields the conduit and the at least one nozzle from heat radiating within the enclosure. The drive mechanism is controlled to then advance or extend the conduit and nozzle into the enclosure for cleaning at least one surface within the enclosure.

What is claimed is:

1. An apparatus for dispensing a liquid under pressure for cleaning a surface in an enclosure, the apparatus comprising:

a conduit having first and second ends, and a passage therein extending to the first end for communicating a liquid under pressure to the first end;

at least one nozzle disposed on the second end of said conduit, for dispensing said liquid under pressure within the passage of said conduit;

a stationary sled configured to be positioned outside of an enclosure for supporting a portion of the conduit while permitting movement of the conduit relative to the stationary sled, such that the second end of the conduit extends horizontally beyond the stationary sled, and the second end of the conduit that extends beyond the stationary sled is unsupported so as to provide a cantilevered end of the conduit, for enabling the at least one nozzle to be extended through an opening in an enclosure to permit dispensing a liquid under pressure within the enclosure, wherein the stationary sled is adjustable for raising and lowering the portion of the conduit supported by the stationary sled; and an adjustable support member that supports the first end portion of the conduit, the adjustable support member being configured to pivot to adjustably raise or lower the first end portion of the conduit for aligning the cantilevered end of the conduit so as to substantially align the at least one nozzle on the second end of the conduit to discharge a stream of liquid under pressure within a generally vertical plane, wherein the cantilevered end of the conduit is configured to extend through an opening in an enclosure, with the conduit being supported only by the adjustable support and the stationary support configured to be positioned outside the enclosure; a linear displacement device configured to controllable move the conduit to extend the at least one nozzle on the cantilevered second end of the conduit through and opening in an enclosure for dispensing a liquid under pressure therein.

2. The apparatus of claim 1, further comprising a displacement device comprising a trolley configured to controllably move the conduit to extend the at least one nozzle on the cantilevered second end of the conduit through an opening in an enclosure for dispensing a liquid under pressure therein.

3. The apparatus of claim 2 wherein the cantilevered end of the conduit extends up to 50 feet beyond the stationary sled, and the trolley is moveable for enabling the at least one nozzle on the end of the conduit to extend at least 50 feet within a boiler enclosure, and the nozzle discharges a liquid under pressure at an effective velocity for enabling discharge up to 25 feet within an enclosure.

4. The apparatus of claim 3 wherein at least part of the length of the conduit and the at least one nozzle are adapted to be extended through an opening in a boiler in which the liquid is dispensed to clean a surface in the boiler.

5. The apparatus of claim 4 further comprising an actuator for selectively rotating the conduit about its longitudinal axis at a desired rate, such that the at least one nozzle on the cantilevered end of the conduit may discharge a liquid under pressure 360 degrees about the axis of the conduit at the cantilevered end for cleaning interior surfaces within the enclosure.

6. The apparatus of claim 5 further comprising a barrel surrounding at least part of the length of conduit, which rotates within the barrel.

7. The apparatus of claim 6 wherein the inner diameter of the barrel surrounding the conduit defines a space between the conduit and barrel in which a coolant is received for conducting heat away from the barrel and conduit, which may be absorbed from heat being radiated within the enclosure.

8. The apparatus of claim 7 wherein the barrel further comprises a suspension support thereon, for reducing the amount of deflection in the cantilevered conduit and length of barrel surrounding the conduit such that the cantilevered end of conduit may be leveled for aligning the at least one nozzle to enable discharge of a stream of liquid under pressure 360 degrees within a generally vertical plane.

9. The apparatus of claim 8 wherein the coolant between the barrel and conduit and the portion of the liquid discharged in the form of a volume of aspirated spray effectively cool the at least one nozzle, barrel and cantilevered end of the conduit extending within a boiler operating in the range of 1000 to 3000 degrees Fahrenheit to hinder droop of the cantilevered end of the conduit to permit the discharge of a stream of liquid under pressure within a generally vertical plane within the boiler for up to four hours.

10. The apparatus of claim 9 wherein the at least one nozzle discharges the liquid at an effective velocity for enabling discharge up to a distance of at least 12 feet for cleaning an interior surface within the enclosure.

11. An apparatus for dispensing a liquid under pressure for cleaning a surface in an enclosure, the apparatus comprising:

a conduit having first and second ends, and a passage therein extending to the first end for communicating a liquid under pressure to the first end;

at least one nozzle disposed on the second end of said conduit, for dispensing said liquid under pressure within the passage of said conduit;

a barrel surrounding at least part of the length of conduit, the barrel having a suspension support thereon for reducing the amount of deflection over the length of the barrel and the cantilevered conduit;

a stationary sled configured to be positioned outside of an enclosure for supporting a portion of the conduit while permitting movement of the conduit relative to the stationary sled, such that the second end of the conduit extends horizontally beyond the stationary sled, and the second end of the conduit extending beyond the stationary sled is unsupported so as to provide a cantilevered end of the conduit, for enabling the at least one nozzle to be extended through an opening in an enclosure to permit dispensing a liquid under pressure within the enclosure, wherein the stationary sled is adjustable for raising and lowering the portion of the conduit supported by the stationary sled;

a linear displacement device configured to controllably move the conduit to extend the at least one nozzle on the cantilevered second end of the conduit through an opening in an enclosure for dispensing a liquid under pressure therein; and an adjustable support member that supports the first end portion of the conduit, being configured to adjustably raise or lower the first end portion of the conduit for aligning the cantilevered end of the conduit so as to substantially align the at least one nozzle on the second end of the conduit to discharge a stream of liquid under pressure within a generally vertical planes;

wherein the conduit and barrel are supported only by the adjustable support and the stationary support that are positioned outside of the enclosure, and the cantilevered end of the conduit, barrel and suspension support on the barrel are configured extend unsupported up to 55 feet beyond the stationary support, to permit cleaning of boiler enclosures up to 50 feet in width.

12. The apparatus of claim 11 further comprising an actuator for selectively rotating the conduit about its longitudinal axis at a desired rate, such that the at least one nozzle on the cantilevered end of the conduit may discharge a liquid under pressure 360 degrees about the axis of the conduit at the cantilevered end for cleaning interior surfaces within the enclosure.

13. The apparatus of claim 12 wherein the barrel surrounds the conduit such that the conduit rotates within the barrel.

14. The apparatus of claim 13 wherein the inner diameter of the barrel surrounding the conduit defines a space between the conduit and barrel in which a coolant is received for conducting heat away from the barrel and conduit which may be absorbed from heat being radiated within the enclosure.

15. The apparatus of claim 14 wherein the barrel suspension support thereon are cooled by a coolant that is received within the barrel and suspension support such that the coolant hinders droop of the cantilevered end of the conduit and barrel when disposed within an enclosure at a temperature of up to 3000 degrees Fahrenheit, for reducing the amount of deflection in the cantilevered conduit and length of barrel surrounding the conduit such that the cantilevered end of conduit may be leveled for aligning the at least one nozzle to enable discharge of a stream of liquid under pressure 360 degrees within a generally vertical plane to spray within spaces less than 2 inches in width.

16. The apparatus of claim 15 wherein the coolant between the barrel and conduit and the portion of the liquid discharged in the form of a volume of aspirated spray effectively cool the at least one nozzle, barrel and cantilevered end of the conduit extending within a boiler operating in the range of 1000 to 3000 degrees Fahrenheit to hinder droop of the cantilevered end of the conduit to permit the discharge of a stream of liquid under pressure within a generally vertical plane within the boiler for up to four hours.

17. The apparatus of claim 16 wherein the at least one nozzle discharges the liquid at an effective velocity for enabling discharge up to a distance of at least 12 feet for cleaning an interior surface within the enclosure.

18. The apparatus of claim 17 wherein the displacement device comprises trolley is moveable along a length of track that enables the at least one nozzle on the cantilevered end of the conduit to be extended at least 12 feet within an enclosure.

19. The apparatus of claim 18 wherein the cantilevered end of the conduit extends up to 60 feet beyond the stationary sled, and the trolley is moveable for enabling the at least one nozzle on the end of the conduit to extend at least 50 feet within a boiler enclosure, and the nozzle discharges a liquid under pressure at an effective velocity for enabling discharge up to 25 feet within an enclosure.

20. The apparatus of claim 19 wherein at least part of the length of the conduit and the at least one nozzle are adapted to be extended through an opening in a boiler in which the liquid is dispensed to clean a surface in the boiler.

* * * * *